US007572109B2

(12) United States Patent
Yang

(10) Patent No.: US 7,572,109 B2
(45) Date of Patent: Aug. 11, 2009

(54) THERMOPNEUMATIC CAPILLARY MICROPUMP AND MANUFACTURING METHOD THEREOF

(75) Inventor: Sang Sik Yang, Seocho-ku (KR)

(73) Assignee: Ajou University Industry-Academic Cooperation Foundation, Gyeonggi-Do (KR)

( * ) Notice: Subject to any disclaimer, the term of this patent is extended or adjusted under 35 U.S.C. 154(b) by 184 days.

(21) Appl. No.: 11/734,045

(22) Filed: Apr. 11, 2007

(65) Prior Publication Data

US 2008/0250639 A1 Oct. 16, 2008

(51) Int. Cl.
*F04F 1/00* (2006.01)
*F04B 19/00* (2006.01)

(52) U.S. Cl. ..... 417/207; 417/52; 417/53; 417/77; 417/118

(58) Field of Classification Search ..... 417/207, 417/51, 52, 53, 65, 77, 118, 208; 29/888.02; 137/806; 216/2; 427/124, 125, 250, 255.28; 438/800

See application file for complete search history.

(56) References Cited

U.S. PATENT DOCUMENTS 2,933,282 A * 4/1960 Falberg ..... 251/73
5,015,274 A * 5/1991 Perry ..... 95/278
5,347,656 A * 9/1994 Fabritz et al. ..... 2/67
6,130,098 A * 10/2000 Handique et al. ..... 436/180
6,422,826 B1 * 7/2002 Sharma et al. ..... 417/54
6,531,417 B2 * 3/2003 Choi et al. ..... 438/800
6,843,263 B2 * 1/2005 Kuo et al. ..... 137/14
7,066,190 B2 * 6/2006 Chen et al. ..... 137/12

OTHER PUBLICATIONS

Hwang, Sung Rae et al., Fabrication and Test of a Submicroliter-level Thermopneumatic Micropump for Transdermal Drug Delivery, 3rd Annual Int'l IEEE EMBS Special Topic Conference on Microtechnologies in Medicine and Biology, May 2005, 143-145.*
Korean patent application entitled Thermopneumatic Capillary Micropump and Manufacturing Method Thereof, Inventor: Sang Sik Yang, Oct. 6, 2005, Korea.
IEEE-EMBS Journal, Fabrication and Test of a Submicroliter-level Thermopneumatic Micropump for Transdermal Drug Delivery, Sang Sik Yang et al, May 12-15, 2005, 3 pages.

* cited by examiner

*Primary Examiner*—Devon C Kramer
*Assistant Examiner*—Nathan Zollinger
(74) *Attorney, Agent, or Firm*—Harness, Dickey & Pierce, P.L.C.

(57) ABSTRACT

According to various aspects, exemplary embodiments are provided of thermopneumatic capillary micropumps and manufacturing methods thereof. In one exemplary embodiment, a thermopneumatic capillary micropump generally includes a lower substrate having a pump-entrance for injecting fluids and a pump-exit for exhausting the fluids. The micropump also includes one or more micro-heaters for generating heat and electrodes for applying voltage to the micro-heaters. One or more air chambers substantially cover the micro-heaters. A pump chamber unit, which is capable of being filled up with the fluids, is coupled to the air chambers, the pump-entrance, and the pump-exit. An airing channel is coupled to the air chambers for helping maintain the pressure of the air in the air chambers at about the same level. An oxide layer is deposited on an upper substrate of the micropump. The upper and lower substrates are thermopneumatically coupled to each other.

20 Claims, 13 Drawing Sheets

THERMOPNEUMATIC CAPILLARY MICROPUMP AND MANUFACTURING METHOD THEREOF

FIELD

The present disclosure relates to micropumps capable of controlling extremely fine fluids in various fields such as chemistry, biotechnology, pharmacy, medical science and environmental engineering, and more particularly, to thermopneumatic capillary micropumps and manufacturing methods thereof capable of flowing nanoliter leveled infinitesimal fluids by a thermopneumatic process.

BACKGROUND

The statements in this section merely provide background information related to the present disclosure and may not constitute prior art.

The traditional and available thermopneumatic micropumps must have a driving thin film for driving, and either a check valve or active valve. These traditional micropumps, however, have disadvantages in that manufacturing is difficult and the cost is expensive, since the structure of the micropump is very complicated.

Moreover, most of the conventional systems for both analysis and detection are expensive and very large in size. Plus, the efficiency and convenience of analysis are usually not good since they require a lengthy analysis time and require many samples.

In the chemistry area, for example, analyzing an unknown material must be done at restricted places due to expensive systems and technical know-how, require a long analysis time, and have some risks associated with exposure of harmful materials to the human body. In the meantime, the analysis system using extremely-fine fluid devices such as Lab-on-a-chip and microsynthesized analysis system generally does not require many samples because of miniaturization of the analysis system. Moreover, manpower and analysis time are all reduced mostly because of automatic inspection processes after inserting a sample. Especially, in case of inspecting a dangerous article having toxicity, the analysis system using extremely-fine fluid devices can minimize (or at least reduce) risks or influences caused to both environment and human body. With the conventional inspection system, however, it is impossible to perform a real-time analysis at the right place in the environmental and military areas.

A portable analysis system applying the extremely-fine-fluids devices, however, can analyze samples in real-time after collecting the samples in virtually any place including extremely hazardous natural environments, polluted regions, and even battle fields. Accordingly, the inventor hereof has recognized a need for fluid devices for controlling the flow of extremely-fine-fluid for use in portable analysis systems.

SUMMARY

According to various aspects, exemplary embodiments are provided of thermopneumatic capillary micropumps and manufacturing methods thereof. In one exemplary embodiment, a thermopneumatic capillary micropump generally includes a lower substrate having a pump-entrance for injecting fluids and a pump-exit for exhausting the fluids. The micropump also includes one or more micro-heaters for generating heat and electrodes for applying voltage to the micro-heaters. One or more air chambers substantially cover the micro-heaters. A pump chamber unit, which is capable of being filled up with the fluids, is coupled to the air chambers, the pump-entrance, and the pump-exit. An airing channel is coupled to the air chambers for helping maintain the pressure of the air in the air chambers at about the same level. An oxide layer is deposited on an upper substrate of the micropump. The upper and lower substrates are thermopneumatically coupled to each other.

Other aspects of the present disclosure relate to methods of manufacturing or making thermopneumatic micropumps. In one exemplary embodiment, a method of manufacturing a thermopneumatic micropump generally includes forming two or more micro-heaters and electrodes coupled to the micro-heaters respectively by patterning after depositing chrome and gold on a lower substrate made of glass by chemical vapor deposition; forming a pump-entrance for injecting fluids and a pump-exit for exhausting the fluids through the lower substrate by using an electric chemical discharging process, respectively; forming two or more air chambers substantially covering the micro-heaters by using photolithography technology after coating a negative thick film photoresist on the lower substrate; forming a pump chamber unit capable of being filled with the fluids, and that is coupled to the pump-entrance, the pump-exit, and the air chambers by using the photolithography technology; forming an airing channel coupled to the air chambers, wherein the airing channel helps maintain the pressures of air in the air chambers at about the same level; depositing an oxide layer on an upper substrate; and coupling the upper substrate and the lower substrate by using thermopneumatic method.

In another exemplary embodiment, a method of manufacturing a thermopneumatic capillary micropump generally includes forming one or more micro-heaters and electrodes coupled to the micro-heaters respectively by patterning after depositing one or more metals on a lower substrate by chemical vapor deposition; forming a pump inlet for receiving fluids and a pump outlet for discharging the fluids through the lower substrate by electric chemical discharging; forming one or more air chambers substantially covering the micro-heaters by using photolithography after coating a negative thick film photoresist on the lower substrate; forming a pump chamber unit air by using the photolithography such that the pump chamber unit is capable of being filled with the fluids and is coupled to the pump-entrance, the pump-exit, and the air chambers; forming an airing channel coupled to the air chambers for helping maintain the pressure of air in the air chambers at about the same level; depositing an oxide layer on an upper substrate; and thermopneumatically coupling the upper substrate and the lower substrate.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 1:
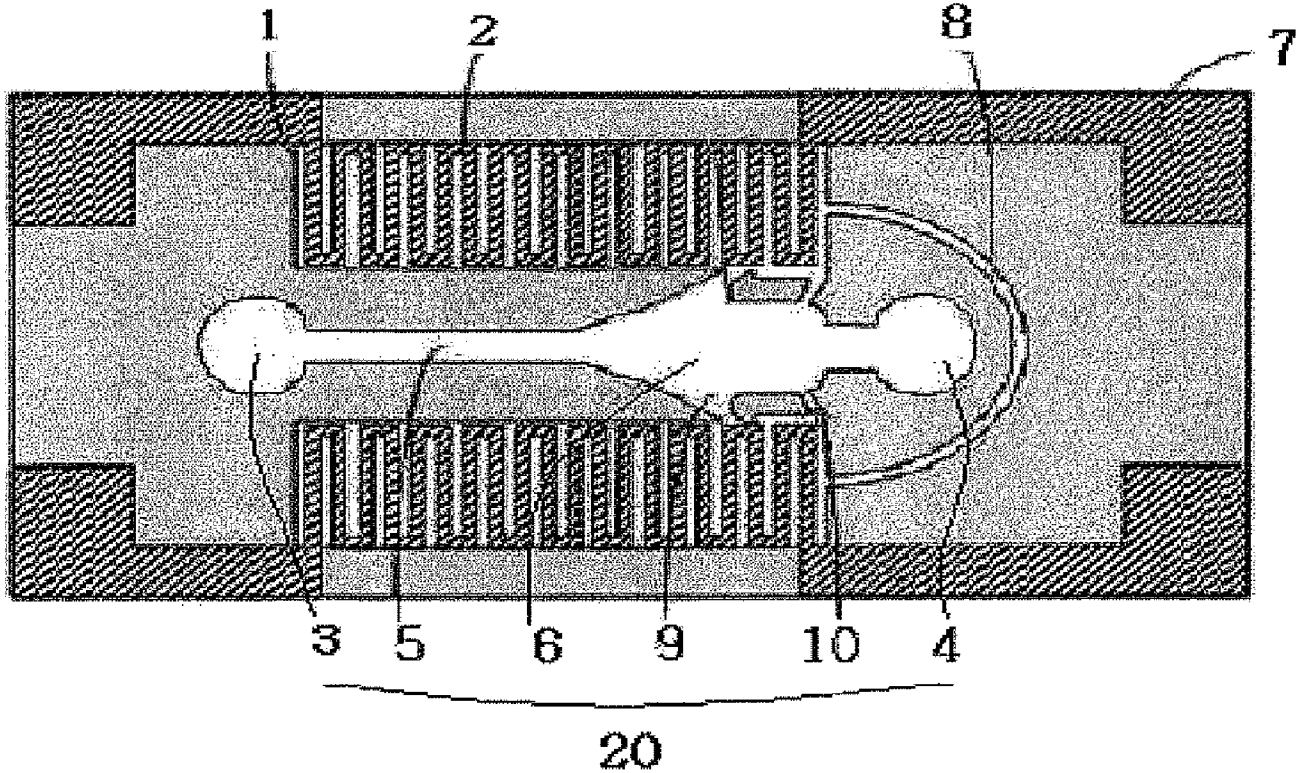
FIG. 1 is a plan view of a thermopneumatic capillary micropump according to exemplary embodiments of the present disclosure.

FIGS. 4(*a*) through 4(*e*) collectively illustrate an exemplary process diagram for manufacturing a thermopneumatic capillary micropump according to exemplary embodiments of the present disclosure.

FIGS. 5(*a*) through 5(*e*) collectively illustrate an exemplary operating diagram of a thermopneumatic capillary micropump according to exemplary embodiments of the present disclosure.

DETAILED DESCRIPTION

The following description is merely exemplary in nature and is not intended to limit the present disclosure, application, or uses. It should be understood that throughout the drawings, corresponding reference numerals indicate like or corresponding parts and features.

Embodiments of the present invention are described more fully hereinafter with reference to the accompanying drawings, in which example embodiments of the present invention are shown. The present invention may, however, be embodied in many different forms and should not be construed as limited to only those embodiments described, illustrated, or otherwise set forth herein. Rather, these exemplary embodiments are provided so that this disclosure will be thorough and complete, and will fully convey the scope of the present invention to those skilled in the art. In the drawings, the sizes and relative sizes of layers and regions may be exaggerated for clarity.

Aspects of the present disclosure relate to thermopneumatic capillary micropumps and manufacturing methods thereof, where the micropumps are operable for controlling extremely-fine-fluid in various fields, such as chemistry, biotechnology, pharmacy, medical science, environmental engineering, etc. In various exemplary embodiments, a thermopneumatic capillary micropump is provided that does not require moving structures, as does some existing pumps and valve structures. In such embodiments, this may meritoriously allow for a less complex structure for the thermopneumatic capillary micropump, which, in turn, allows for a less complex and less costly manufacturing process.

In various embodiments, a thermopneumatic capillary micropump generally includes a lower substrate, micro-heaters, electrodes, air chambers, a pump chamber unit, an airing channel, an upper substrate, and an oxide layer deposited on the upper substrate. During an exemplary operation, electrical current flow into the micro-heaters produces heat that heats the air in the air chambers. Upon heating, the air in the air chambers is expanded such that the air may push fluids in a pump chamber against a pump-exit or outlet. The airing channel (which is fluidically connected and coupled to both air chambers) helps maintain the pressures of air in the air chambers at about the same level. Moreover, since a fluid resistance of a capillary tube is sufficiently high enough, the fluids in the pump chamber exhaust against the pump-exit. When the fluids in the pump chamber completely exhaust, the electrical current flow applied to the micro-heaters may then be cut off to thereby allow the expanded air to cool and contract. In the meantime, due to surface tension on a fluid borderline between the pump chamber and the pump-exit, the fluids are not injected into the pump chamber from the pump-exit, but into the pump chamber from the pump-entrance.

In one exemplary embodiment, a thermopneumatic capillary micropump generally includes two or more micro-heaters (e.g., ohmic heaters, etc.) and electrodes operatively connected to the micro-heaters by patterning after depositing both chrome and gold, for example, on a lower substrate made of glass by chemical vapor deposition method. A pump-entrance injecting fluid and a pump-exit exhausting the fluids through the lower substrate are formed by using an electric chemical discharging process. Air chambers substantially covering the micro-heaters are formed by using photolithography technology after coating a negative thick film photoresist on the lower substrate. A pump chamber unit capable of being filled up with the fluids is also formed by using the photolithography technology. The pump chamber unit is connected to the pump-entrance, the pump-exit, and the air chambers. An airing channel is connected to the air chambers. The airing channel is operable for helping maintain the pressures of air in the air chambers at about the same level. An oxide layer is deposited on an upper substrate. The upper and lower substrates may coupled by using thermopneumatic method.

In some preferred embodiments, the electrodes are formed on regions at four corners of the lower substrate, and the lower substrate comprises Pyrex glass. In addition, the pump chamber unit may preferably comprise a capillary tube connected to the pump-entrance and a pump chamber containing fluids. The pump chamber may be connected to the capillary tube, as well as to a main pneumatic channel and a subsidiary pneumatic channel for guiding the flow of air between the pump chamber and the air chambers. Preferably, the subsidiary pneumatic channel exhausts air remaining in the pump chamber as fluids are filled up to the main pneumatic channel through the pump chamber.

According to another aspect of the present disclosure, there is provided a thermopneumatic capillary micropump comprising a lower substrate having both a pump-entrance injecting fluids and a pump-exit exhausting the fluids. The micropump also includes a couple of micro-heaters generating heat by voltage supplied, wherein the micro-heaters are formed at facing locations on the lower substrate. Electrodes apply voltage to the micro-heaters, and a couple of air chambers cover the micro-heaters respectively. The micropump also includes a pump chamber unit capable of being filled up with the fluids, wherein the pump chamber unit is connected to the air chamber, the pump-entrance and the pump-exit. An airing channel is connected to the air chambers, wherein the airing channel maintains the pressure of air in the respective air chambers at about the same level. The micropump also includes an upper substrate, and an oxide layer deposited or otherwise formed on the upper substrate. The upper substrate is coupled or connected to the lower substrate by thermopneumatic method.

In some preferred embodiments, the pump-entrance and the pump-exit are formed through the lower substrate. The pump chamber unit preferably comprises a capillary tube connected to the pump-entrance and a pump chamber containing the fluids. The pump chamber is preferably connected to the capillary tube, as well as to a main pneumatic channel and a subsidiary pneumatic channel for guiding the flow of air between the pump chamber and the air chambers. Preferably, the subsidiary pneumatic channel exhausts air remaining in the pump chamber as fluids are filled up to the main pneumatic channel through the pump chamber. Preferably, the micro-heaters and the electrodes are all formed by patterning after depositing both chrome and gold on a lower substrate by chemical vapor deposition method. Preferably, the air chamber, the pump chamber unit, and the airing channel are all formed by using photolithography technology after coating a negative thick film photoresist on the lower substrate.

Figure 2:
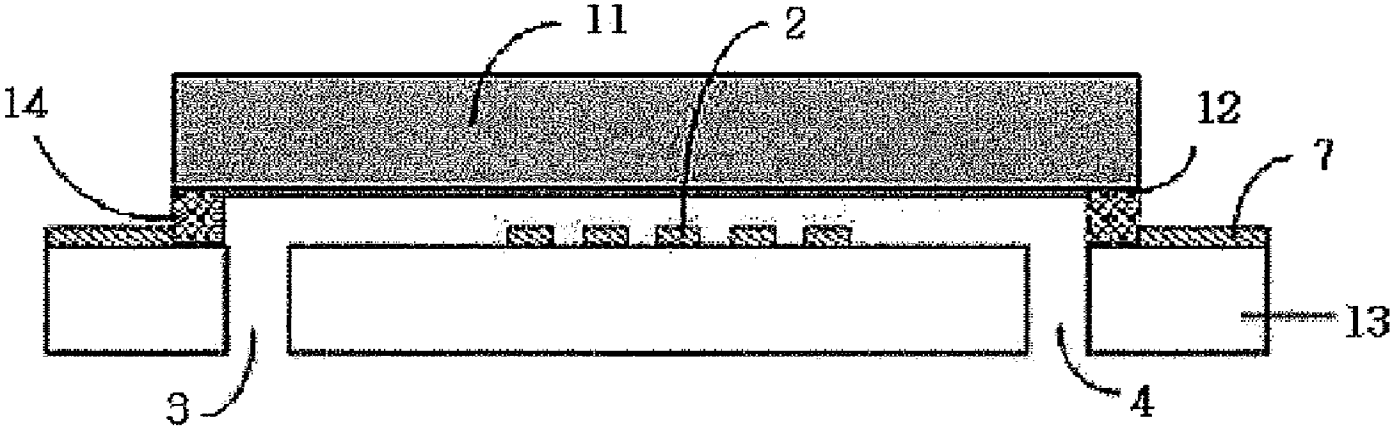
FIG. 2 is a cross-sectional view of a thermopneumatic capillary micropump according to exemplary embodiments of the present disclosure.

With reference now to the drawings, and particularly to FIGS. 1 and 2, an exemplary embodiment is shown of a thermopneumatic capillary micropump. As shown in FIGS. 1 and 2, the micropump includes a lower substrate 13, a couple of micro-heaters 2, electrodes 7, a couple of air chambers 1, a pump chamber unit 20, an airing channel 8, an upper substrate 11, and an oxide layer 12.

The oxide layer 12 may be formed (e.g., deposited, etc.) on the upper substrate 11. The upper substrate 11 may be formed from silicon or other suitable material. The oxide layer 12 may comprise a silicone dioxide layer or other suitable material. And, a couple of air chambers 1, a pump chamber unit 20, an airing channel 8, and micro-heaters 2 are all formed on the lower substrate 13. A final manufactured micropump may be a structure connected to both the upper substrate 11 and the lower substrate 13. The pump chamber unit 20 may have fluids flowing into or out of the pump chamber unit 20 as well as containing the fluids. The pump chamber unit 20 may be made of negative thick film photoresist 14 (e.g., SU-8-2100, etc.). The micro-heaters 2 may be made of one or more metals (e.g., chrome gold, silver, combinations thereof, etc.) Alternatively, other suitable materials may also be used for forming one or more ohmic heater for use in an embodiment of a micropump.

The lower substrate 13 may comprise a pump-entrance or inlet 3 for receiving or injecting fluids. The lower substrate 13 may also include a pump-exit or outlet 4 for exhausting or discharging fluids. The pump-entrance 3 and pump-exit 4 may all be formed through the lower substrate 13, as shown in FIG. 2. The micro-heaters 2 may be formed at facing locations on the lower substrate 13, respectively, and generate heat when voltage is applied to the micro-heaters 2. The electrodes 7 may be operable for applying the voltage to the micro-heaters 2. As illustrated in FIG. 1, the electrodes 7 may be formed in regions at about the four corners of the lower substrate 13. The electrodes 7 may be coupled or connected to the micro-heaters 2 for applying voltage thereto.

The micro-heaters 2 and the electrodes 7 may be formed on the lower substrate 13 by patterning after depositing both chrome and gold via chemical vapor deposition, which will be disclosed in more detail below.

The air chambers 1 may generally surround the micro-heaters 2, respectively. The pump chamber 6 may be coupled or connected to the pump-entrance 3, to the pump-exit 4, and to the air chambers 2. The pump chamber 6 may also be filled up with fluids. The airing channel 8 may be coupled or connected to the air chambers 1. The airing channel 8 may maintain or help maintain the pressure of air in the air chambers 1 at about the same level.

The air chambers 1, the pump chamber unit 20, and the airing channel 8 may all be formed by using photolithography technology after coating negative thick film photoresist 14, as will be disclosed in more detail below. The upper substrate 11 may be coupled or connected to the lower substrate 13 by thermopneumatic method, and the oxide layer 12 may be deposited.

A thermopneumatic capillary micropump according to embodiments of the present invention may be driven by thermopneumatic driving method. The thermopneumatic driving method may use changes of air volume so as to get relatively high driving power at relatively low voltages. The thermopneumatic capillary micropump according to embodiments of the present invention may generate the driving power of the pump with the air chambers 1 and the micro-heaters 2. A thermopneumatic capillary micropump according to embodiments of the present invention may have a less complex structure. Moreover, thermopneumatic capillary micropumps according to embodiments of the present invention may be implemented by a micromachining technology, and with a manufacturing process that is less complex and with a fairly easy integration.

A thermopneumatic capillary micropump according to an embodiment of the present invention may be operated as follows. If current flows into the micro-heaters 2 through the electrodes 7, air in the air chambers 1 is expanded by heat generated such that air may be injected into the pump chamber unit 20. Namely, air in the air chambers 1 may be injected to the pump chamber 6 through the main pneumatic channel 9 and the subsidiary pneumatic channel 10.

The pump chamber unit 20 may comprise a pump chamber 6 containing fluids. The pump chamber unit 20 may also include a capillary tube 5 coupled or connected to both the pump-entrance 3 and the pump chamber 6. The main pneumatic channel 9 and subsidiary pneumatic channel 10 guide the flow of air between the pump chamber 6 and the air chambers 1.

As illustrated above, in case of the operation of which the thermopneumatic capillary micropump exhausts fluids contained in the pump chamber 6 through the pump-exit 4, the air in the air chamber 1 may be injected into the pump chamber 6 through both the main pneumatic channel 9 and the subsidiary pneumatic channel 10 so as to push the fluids towards the pump-exit 4. In the meantime, the fluids in the pump chamber 6 may only be exhausted into the pump-exit 4, since the air chambers 1 maintain substantially the same pressure due to the airing channel 8, and sufficiently high enough fluid resistance of the capillary tube 5. When the fluids in the pump chamber 6 are completely exhausted, the voltages applied to the micro-heaters 2 may be cut off so that the air expanded may be shrunken or allowed to coot and contract. Then, due to surface tension on a fluid borderline or boundary between the pump chamber 6 and the pump-exit 4, the exhausting of fluids to the pump-exit 4 may cease. However, fluids injected into the pump-entrance 3 may be injected into the pump chamber 6 through the capillary tube 5.

Figure 3:
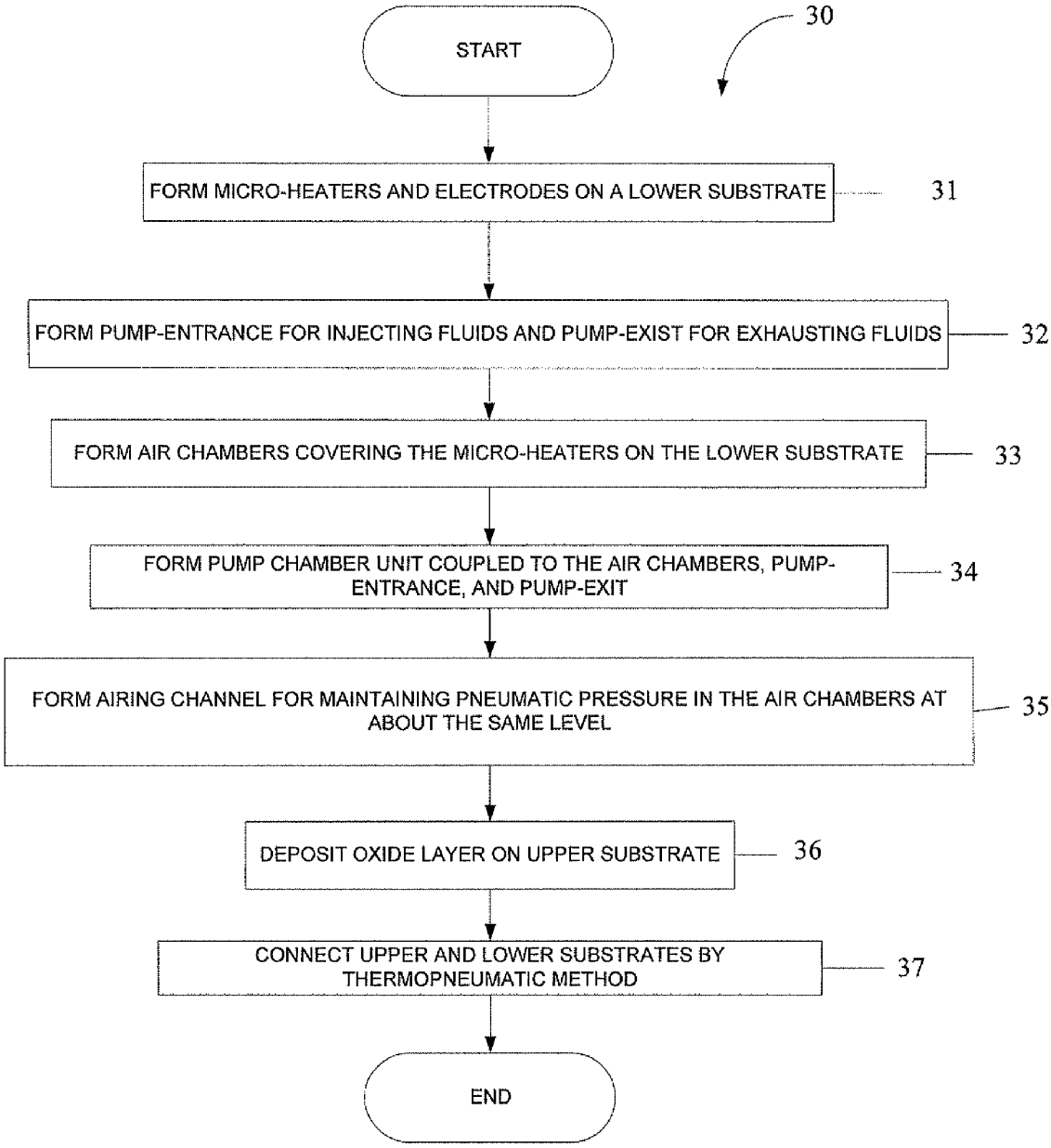
FIG. 3 is a flow chart illustrating an exemplary manufacturing method of a thermopneumatic capillary micropump according to exemplary embodiments of the present disclosure.
Figure 4A:
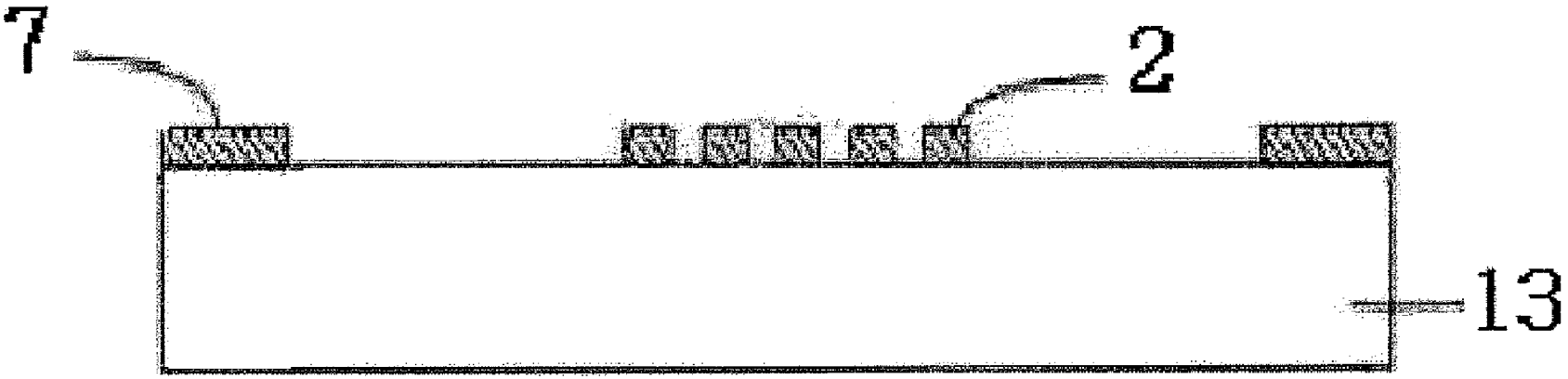
Figure 4B:
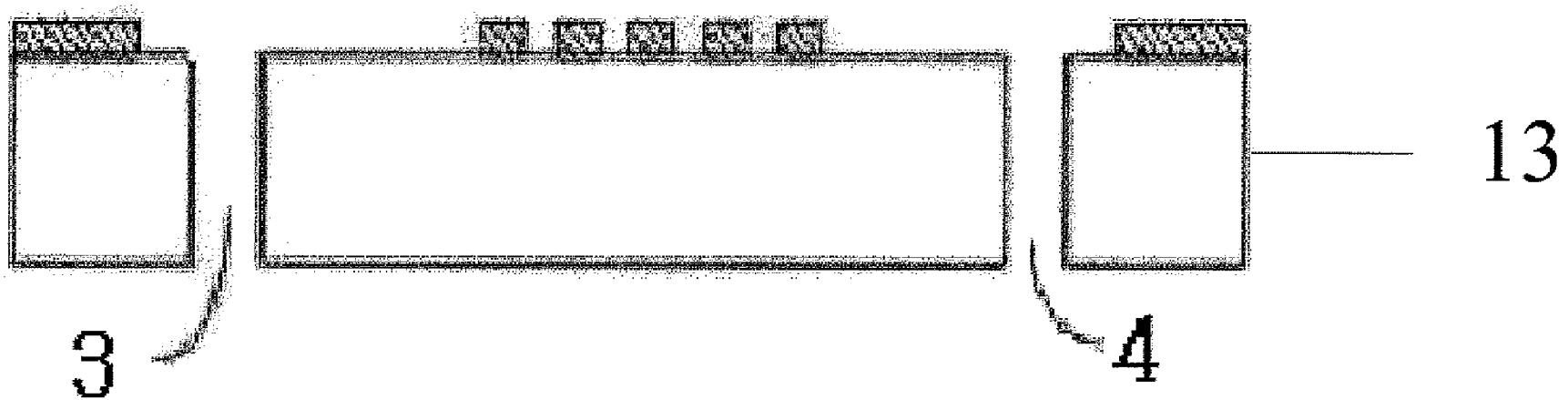
Figure 4C:
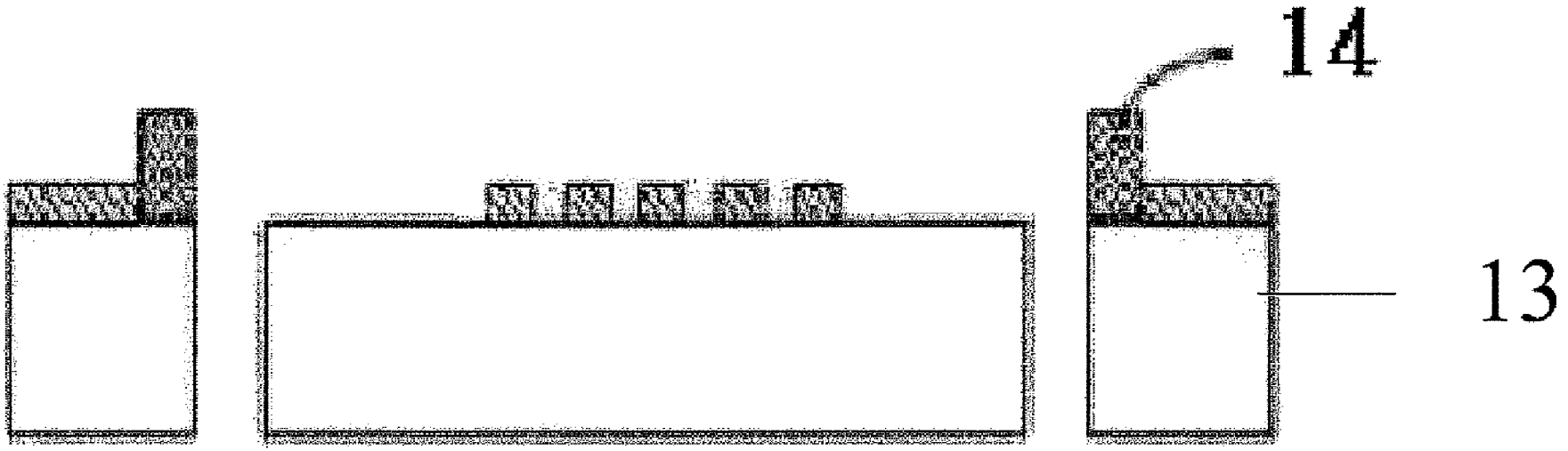
Figure 4D:
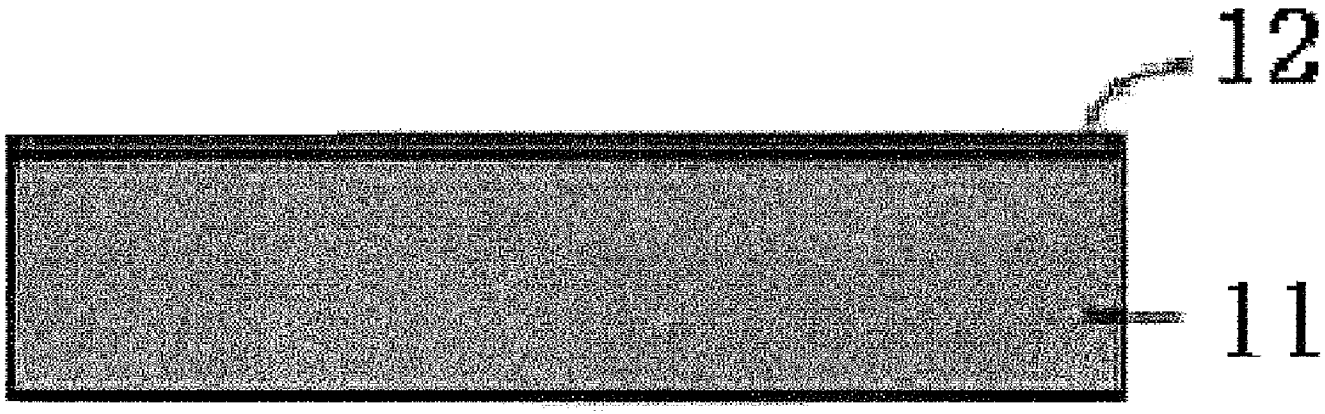
Figure 4E:
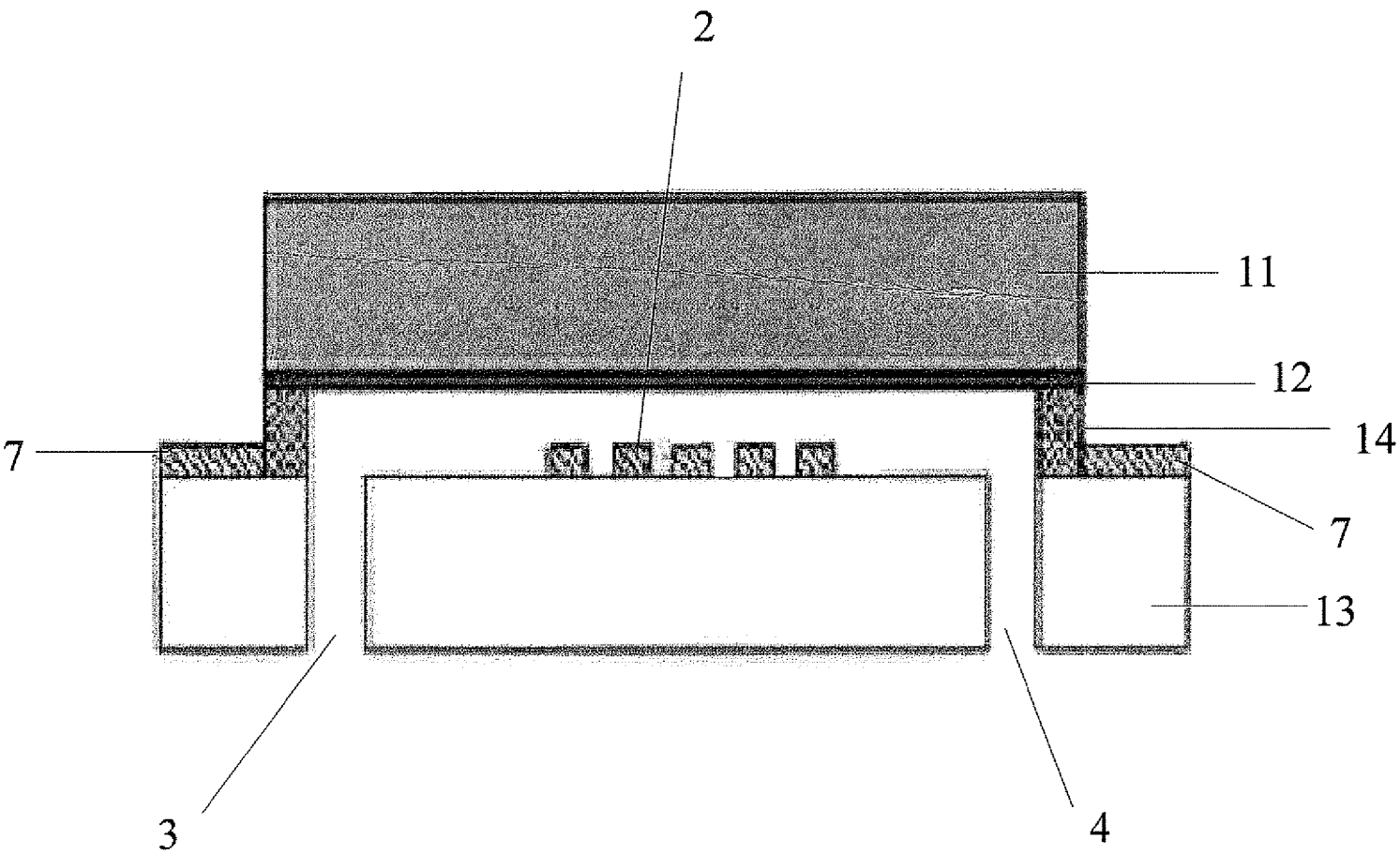
Figure 5A:
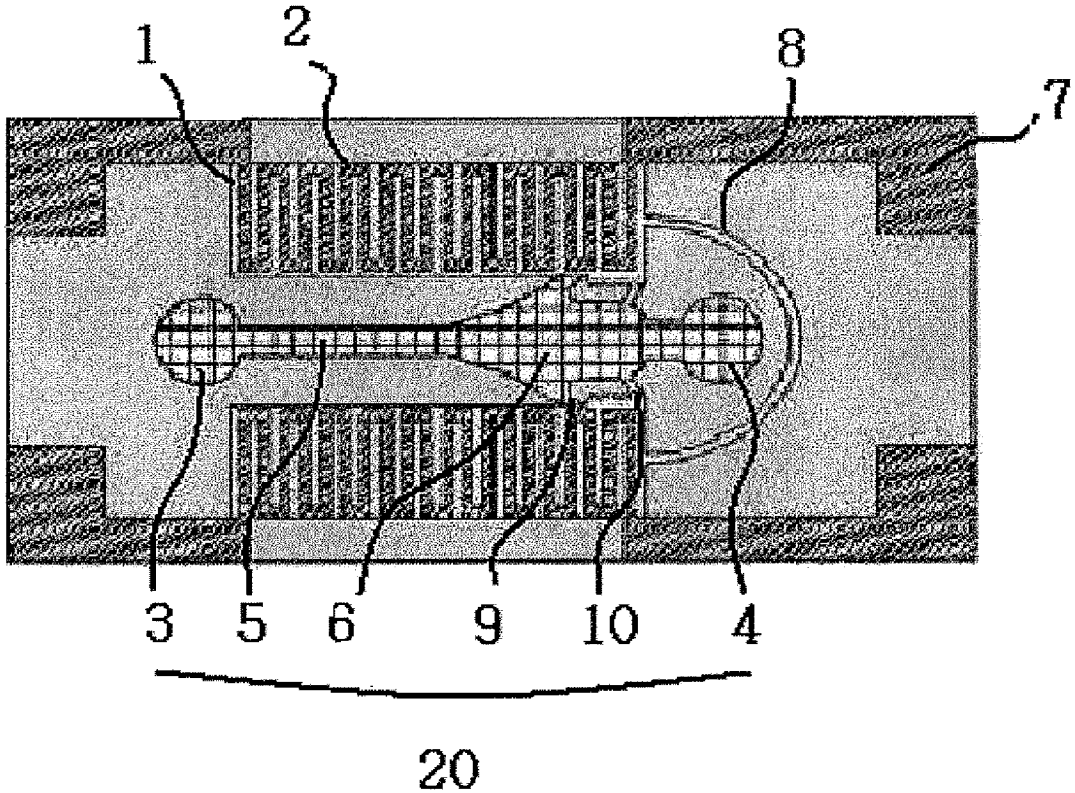
Figure 5B:
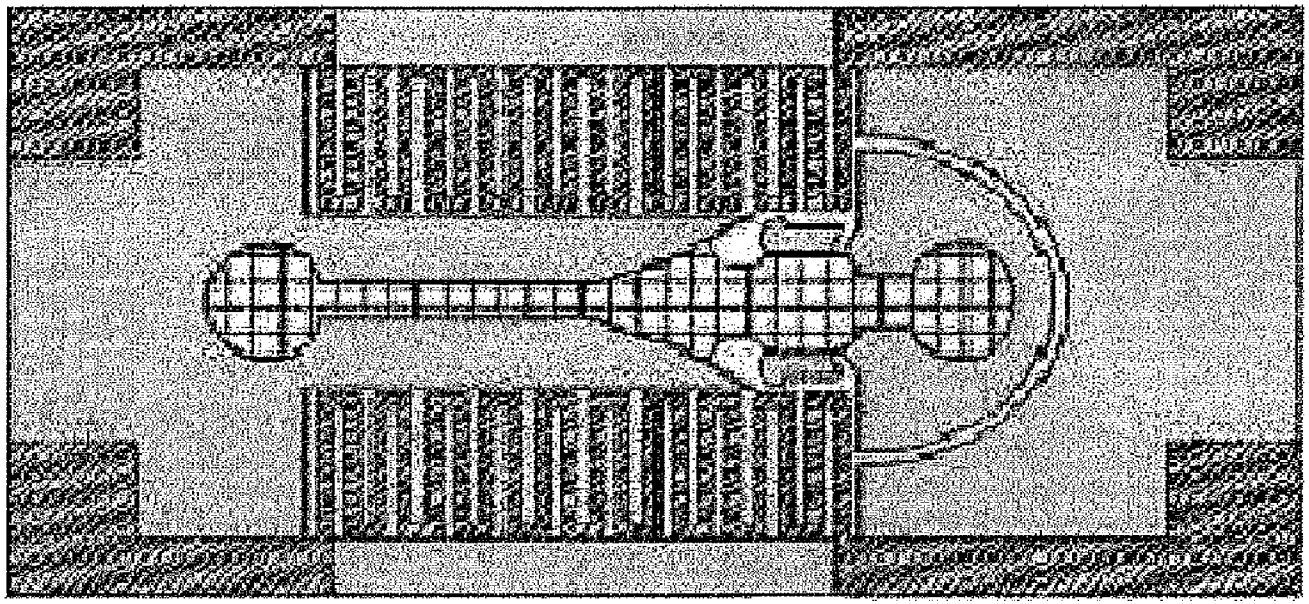
Figure 5C:
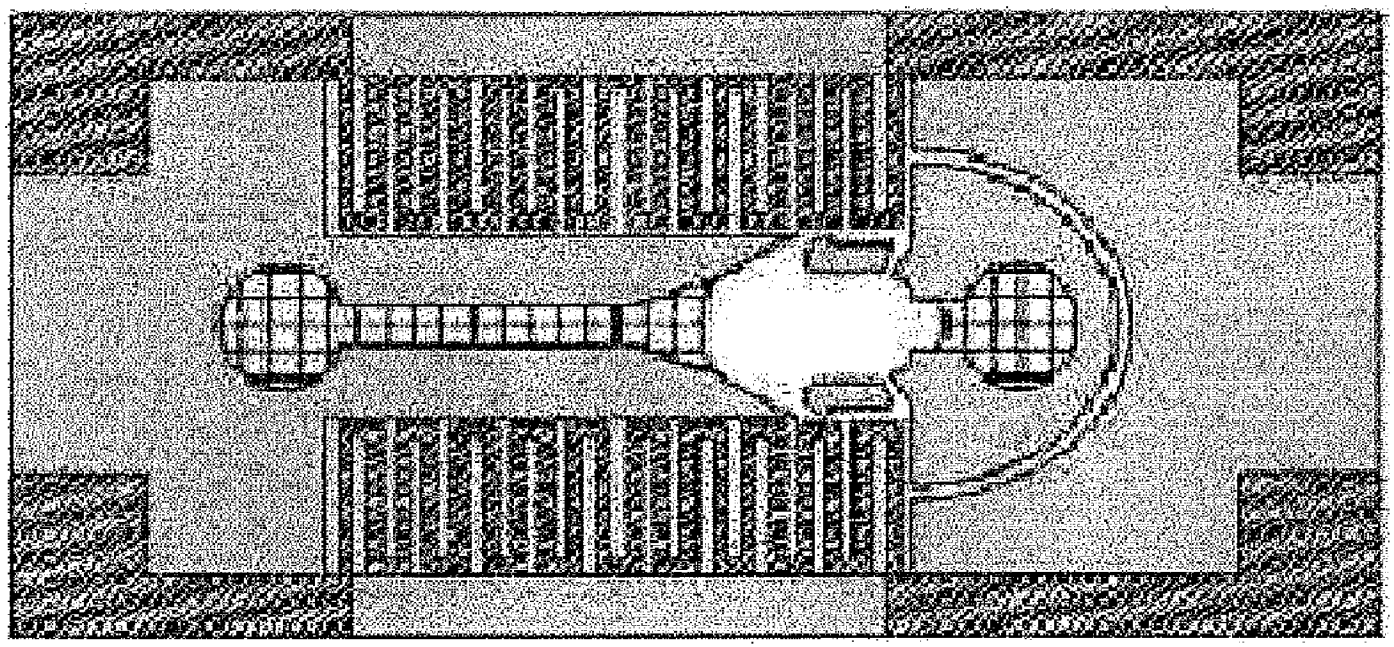
Figure 5D:
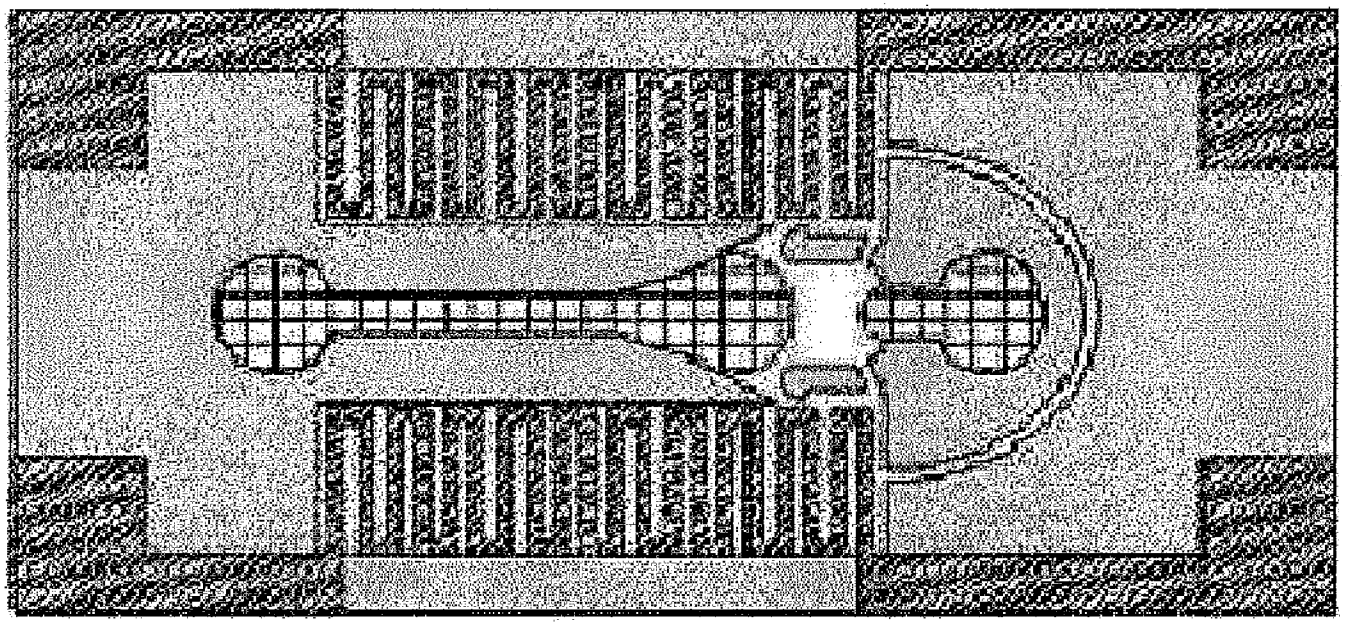
Figure 5E:
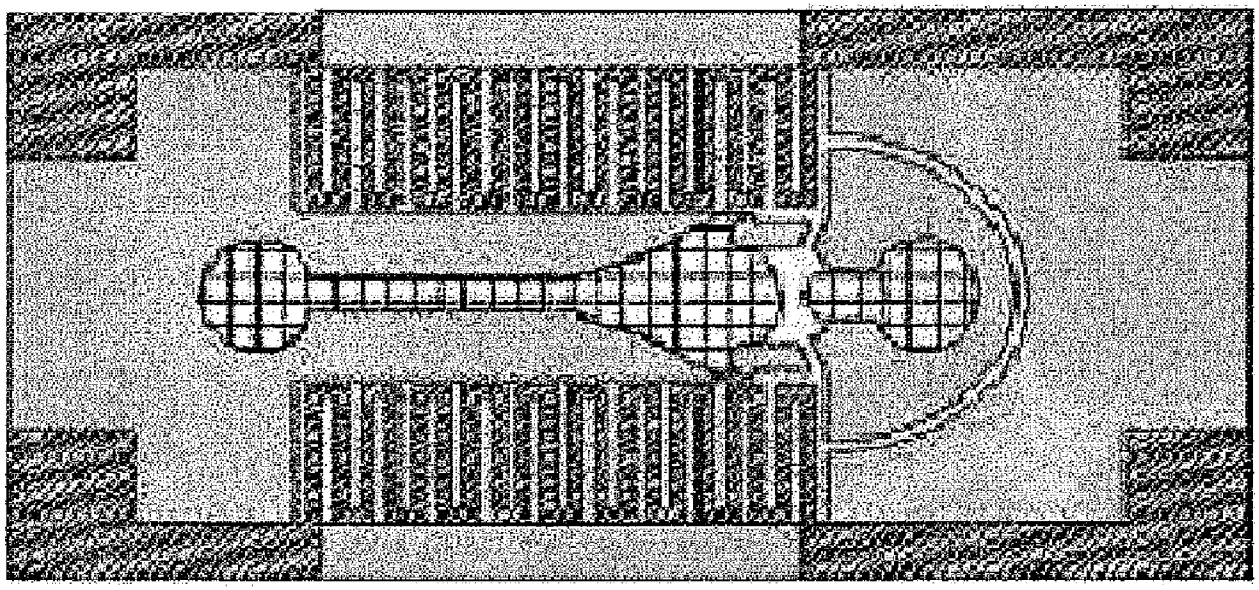

FIG. 3 is a flow chart illustrating an exemplary manufacturing method of a thermopneumatic capillary micropump according to embodiments of the present invention. FIGS. 4(*a*) through 4(*e*) collectively illustrate a manufacturing process diagram of a thermopneumatic capillary micropump according to exemplary embodiments of the present invention.

In these exemplary embodiments, the method 30 (FIG. 3) may include a step or process 31 of forming micro-heaters 2 and electrodes 7 coupled or connected to the micro-heaters 7 on a lower substrate 13 (FIG. 4(*a*)), for example, by patterning after depositing (e.g., chemical vapor deposition, etc.) both chrome and gold (or other suitable materials) on the lower substrate 13 (e.g., Pyrex glass substrate, etc.).

By way of example, the micro-heaters 2 and electrodes 7 may be formed by using a micromachining technology after depositing both chrome and gold on the lower substrate 13 by chemical vapor deposition. Glass may be used for making the lower substrate 13, such as Pyrex glass, other suitable glass materials, etc.

At step or process 32 (FIG. 3), a pump-entrance 3 for injecting fluids and a pump-exit 4 for exhausting the fluids may be formed through the lower substrate 13 (FIG. 4(*b*), for example, by using an electric chemical discharging process. As illustrated in FIG. 4(*b*), the pump-entrance 3 and the pump-exit 4 may be formed by using electric chemical discharging method (ECDM), where the pump-entrance 3 and pump-exit 4 are operable to inject/receive fluids into and exhaust/discharge fluids out of the thermopneumatic capillary micropump.

At step or process 33 (FIG. 3), two air chambers 1 may be formed to substantially or entirely cover the micro-heaters 2, for example, by using photolithography technology after coating a negative thick film photoresist 14 on the lower substrate 13 (FIG. 4(*c*)). Similarly, at step or process 34 (FIG. 3), a pump chamber unit 20 may be formed that is connected or coupled to the pump-entrance 3, to the pump-exit 4, and the air chambers 1, for example, by using photolithography technology.

The pump chamber unit 20 may comprise a capillary tube 5 coupled or connected to the pump-entrance 3. The pump chamber unit 20 may also include a pump chamber 6 containing fluids, as well as a main pneumatic channel 9 and a subsidiary pneumatic channel 10. The channels 9 and 10 define flow paths for air between the pump chamber 6 and the air chambers 1. The capillary tube 5, the pump chamber 6, and the main pneumatic channel 9 and subsidiary pneumatic channel 10 may all be formed at step or process 34 (FIG. 3). The air chambers 1 may be connected to each other, for example, by using photolithography technology. At process 35 (FIG. 3), an airing channel 8 may be formed for maintaining pressure of air in the respective air chambers 1 at about the same level.

At step or process 36 (FIG. 3), an oxide layer 12 may be formed (e.g., deposited, etc.) on the upper substrate 11 (FIG. 4(*d*)). At step or process 37 (FIG. 3), the upper and lower substrates 11 and 13 may be coupled or connected to each other by thermopneumatic method (FIG. 4(*e*)) (e.g., by applying heat and pressure to bond the Pyrex glass lower substrate 13 to the silicone upper substrate 11 and oxide layer 12), thereby completing a thermopneumatic capillary micropump according to exemplary embodiments of the present invention.

FIG. 5 is an operating diagram of a thermopneumatic capillary micropump according to exemplary embodiments of the present invention. Referring to FIG. 5(*a*), fluids in the pump-entrance 3 may flow into the pump chamber 6 due to capillary attraction of the capillary tube 5. Then, if voltages are applied to the electrodes 7, air in the air chambers 1 may be expanded by the heat generated by the micro-heaters 2 when voltage is applied thereto by the electrodes 7. The air in the air chambers 1 may then inject or flow into the pump chamber 6 through both the main pneumatic channel 9 and the subsidiary pneumatic channel 10, as illustrated in FIG. 5(*b*). As the air continues to inject into the pump chamber 6, the fluids contained in the pump chamber 6 may exhaust or discharge to outside through the pump-exit 4, as illustrated in FIG. 5(*c*). In the meantime, the airing channel 8 (which is coupled or connected to both of the air chambers 1) may maintain the pressures of air in the air chambers 1 at about the same level, even though the air is expanded from the heat generated by the micro-heaters 2.

After completely exhausting the fluids to outside, the voltages applying to the electrodes 7 are disconnected. Then, the micro-heaters 2 are cooled down so that the volume of the air injected into the pump chamber 6 may be shrunken or allowed to contract upon cooling. Therefore, the air in the pump chamber 6 may only flow into the air chambers 1. As the air flows into the air chambers 1, fluids in the pump-entrance 3 may only flow into the pump chamber 6 due to capillary attraction of the capillary tube 5, as illustrated in FIG. 5(*d*). Fluids in the pump-exit 4 may not flow into the pump chamber 6 due to surface tension at the fluid borderline between the pump chamber 6 and the pump-exit 4. If the fluids block the main pneumatic channel 9, as illustrated in FIG. 5(*e*), the shrunken or contracted air may only flow into the air chambers 1 through the subsidiary pneumatic channel 10. The fluids may finally fill up the pump chamber 6, as illustrated in FIG. 5(*a*). The subsidiary pneumatic channel 10 may exhaust the air remaining in the pump chamber 6, even though the entrance of the main pneumatic channel 9 is blocked by the fluids.

As illustrated above, the thermopneumatic capillary micropump may control and supply fluids of several microliters or even nanoliters accurately in comparison with the conventional pump. Moreover, the thermopneumatic capillary micropump does not require both valves and driving films other than the conventional micropump. Accordingly, embodiments of the present invention provide for thermopneumatic capillary micropumps having less complex or complicated structures which, in turn, allow for a less complex and less costly manufacturing process, such that they may be widely used in pharmacy, chemistry, etc.

It will be understood that when an element or layer is referred to as being "on", "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present. As used herein, the term "and/or" includes any and all combinations of one or more of the associated listed items.

It will be understood that, although the terms first, second, third, etc. may be used herein to describe various elements, components, regions, layers, and/or sections, these elements, components, regions, layers and/or sections should not be limited by these terms. These terms "first", "second" and other such numerical terms referring to structures do not imply a sequence or order unless clearly indicated by the context. These terms are only used to distinguish one element, component, region, layer or section from another region, layer or section. Thus, a first element, component, region, layer or section discussed herein could be termed a second element, component, region, layer or section without departing from the teachings of the present invention.

Spatially relative terms, such as "beneath", "below", "lower", "above", "upper" and the like, may be used herein for ease of description to describe one element or feature's relationship to another elements or features as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented rotated ninety degrees or at other orientations and the spatially relative descriptors used herein interpreted accordingly. Certain terminology is used herein for purposes of reference only, and thus is not intended to be limiting. For example, terms such as "upper", "lower", "above", "below", "top", "bottom", "upward", and "downward" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import.

The terminology used herein is for the purpose of describing particular embodiments only and is not intended to be limiting of the present invention. As used herein, the singular forms "a", "an", "the", and "said" are intended to include the plural forms as well, unless the context clearly indicates otherwise. Accordingly, when introducing elements or features and the exemplary embodiments, the articles "a", "an", "the" and "said" are intended to mean that there are one or more of such elements or features.

It will be further understood that the terms "comprises", "comprising", "includes", "including", "has", "have", and/or "having" when used in this specification, specify the presence of stated features, integers, steps, operations, elements, and/or components, but do not preclude the presence or addition of one or more other features, integers, steps, operations, elements, components, and/or groups thereof. The terms "comprises," "comprising," "includes," "including," "has," "have," and/or "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

Example embodiments of the present invention are described herein with reference to cross-section illustrations that are schematic illustrations of idealized embodiments and intermediate structures of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing.

Unless otherwise defined, all terms including technical and scientific terms used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The foregoing is illustrative of various exemplary embodiments of the present invention and is not to be construed as limiting thereof. Although a few example embodiments of the present invention have been described, those skilled in the art will readily appreciate that many modifications are possible in the example embodiments without materially departing from the novel teachings and advantages of the present invention. Accordingly, all such modifications are intended to be included within the scope of the present invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. A method of manufacturing a thermopneumatic capillary micropump, the method comprising:

forming two or more micro-heaters and electrodes coupled to the micro-heaters respectively by patterning after depositing chrome and gold on a lower substrate made of glass by chemical vapor deposition;

forming a pump-entrance for injecting fluids and a pump-exit for exhausting the fluids through the lower substrate by using an electric chemical discharging process, respectively;

forming two or more air chambers substantially covering the micro-heaters by using photolithography technology after coating a negative thick film photoresist on the lower substrate;

forming a pump chamber unit capable of being filled with the fluids, and that is coupled to the pump-entrance, the pump-exit, and the air chambers by using the photolithography technology;

wherein the pump chamber unit comprises:

a capillary tube coupled to the pump-entrance;

a pump chamber for containing fluids, the pump chamber being coupled to the capillary tube;

a main pneumatic channel and a subsidiary pneumatic channel for guiding the flow of air between the pump chamber and the air chambers;

wherein the subsidiary pneumatic channel exhausts air remaining in the pump chamber as fluids are filled up to the main pneumatic channel through the pump chamber;

forming an airing channel coupled to the air chambers, wherein the airing channel helps maintain the pressures of air in the air chambers at about the same level;

depositing an oxide layer on an upper substrate; and coupling the upper substrate and the lower substrate by using thermopneumatic method.

2. The method of claim 1, wherein the electrodes are formed on regions at about four corners of the lower substrate, respectively.

3. The method of claim 1, wherein the glass comprises Pyrex.

4. A thermopneumatic capillary micropump comprising:

a lower substrate having a pump-entrance for injecting fluids and a pump-exit for exhausting the fluids;

two or more micro-heaters for generating heat, wherein the micro-heaters are formed at generally facing locations on the lower substrate, respectively;

two or more electrodes for applying voltage to the micro-heaters;

two or more air chambers substantially covering the micro-heaters respectively;

a pump chamber unit capable of being filled up with the fluids, the pump chamber unit being coupled to the air chambers, the pump-entrance, and the pump-exit;

wherein the pump chamber unit comprises:

a capillary tube coupled to the pump-entrance;

a pump chamber for containing fluids, the pump chamber being coupled to the capillary tube;

a main pneumatic channel and a subsidiary pneumatic channel for guiding the flow of air between the pump chamber and the air chambers;

wherein the subsidiary pneumatic channel exhausts air remaining in the pump chamber as fluids are filled up to the main pneumatic channel through the pump chamber;

an airing channel coupled to the air chambers for helping maintain the pressure of the air in the air chambers at about the same level; and an upper substrate having an oxide layer deposited thereon, the upper substrate being coupled to the lower substrate by thermopneumatic method.

5. The thermopneumatic capillary micropump of claim 4, wherein the pump-entrance and the pump-exit are formed through the lower substrate.

6. The thermopneumatic capillary micropump of claim 4, wherein the micro-heaters and the electrodes are formed by patterning after depositing both chrome and gold on the lower substrate by chemical vapor deposition.

7. The thermopneumatic capillary micropump of claim 4, wherein the air chamber, the pump chamber unit, and the airing channel are formed by using photolithography technology after coating a negative thick film photoresist on the lower substrate.

8. The thermopneumatic capillary micropump of claim 4, wherein the pump chamber unit is disposed generally between the micro-heaters.

9. A method of manufacturing a thermopneumatic capillary micropump, the method comprising:

forming one or more micro-heaters and electrodes coupled to the micro-heaters respectively by patterning after depositing one or more metals on a lower substrate by chemical vapor deposition;

forming a pump inlet for receiving fluids and a pump outlet for discharging the fluids through the lower substrate by electric chemical discharging;

forming one or more air chambers substantially covering the micro-heaters by using photolithography after coating a negative thick film photoresist on the lower substrate;

forming a pump chamber unit by using the photolithography such that the pump chamber unit is capable of being filled with the fluids and is coupled to the pump-entrance, the pump-exit, and the air chambers; the pump chamber unit comprising:

a capillary tube coupled to the pump-entrance;

a pump chamber for containing fluids, the pump chamber being coupled to the capillary tube;

a main pneumatic channel and a subsidiary pneumatic channel for guiding the flow of air between the pump chamber and the air chambers, the subsidiary pneumatic channel exhausting air remaining in the pump chamber as fluids are filled up to the main pneumatic channel through the pump chamber;

forming an airing channel coupled to the air chambers for helping maintain the pressure of air in the air chambers at about the same level;

depositing an oxide layer on an upper substrate; and thermopneumatically coupling the upper substrate and the lower substrate.

10. The method of claim 9, wherein the one or more metals deposited on the lower substrate by chemical vapor deposition comprise chrome and gold.

11. The method of claim 9, wherein the lower substrate comprises Pyrex glass.

12. The method of claim 9, wherein the upper substrate comprises silicon, and wherein the oxide layer comprises silicone dioxide.

13. The method of claim 9, wherein thermopneumatically coupling the upper substrate and the lower substrate comprises applying heat and pressure to bond the lower substrate to the upper substrate.

14. The method of claim 9, wherein the negative thick film photoresist comprises a SU-8-2100 photoresist.

15. The method of claim 9, wherein the pump chamber unit is disposed generally between the one or more micro-heaters, and wherein the electrodes are formed on regions of the lower substrate at about the four corners of the lower substrate.

16. The method of claim 1, wherein the pump chamber restrains the movement of the fluids using surface tension on the fluids positioned between the pump chamber and the pump-exit.

17. The method of claim 1, wherein the airing channel helps prevent the fluids from filling the two or more air chambers.

18. The method of claim 4, wherein the pump chamber restrains the movement of the fluids using surface tension on the fluids positioned between the pump chamber and the pump-exit.

19. The method of claim 4, wherein the airing channel helps prevent the fluids from filling the two or more air chambers.

20. The method of claim 9, wherein the pump chamber restrains the movement of the fluids using surface tension on the fluids positioned between the pump chamber and the pump-exit, and wherein wherein the airing channel helps prevent the fluids from filling the one or more air chambers.

* * * * *